US009410341B1

(12) United States Patent
Welch

(10) Patent No.: US 9,410,341 B1
(45) Date of Patent: Aug. 9, 2016

(54) CANOPY AND TABLE FRAME ASSEMBLY

(71) Applicant: John R. Welch, Austin, TX (US)

(72) Inventor: John R. Welch, Austin, TX (US)

( * ) Notice: Subject to any disclaimer, the term of this patent is extended or adjusted under 35 U.S.C. 154(b) by 0 days.

(21) Appl. No.: 14/847,591

(22) Filed: Sep. 8, 2015

Related U.S. Application Data

(60) Provisional application No. 62/061,920, filed on Oct. 9, 2014.

(51) Int. Cl.

| | |
|---|---|
| ***E04H 15/02*** | (2006.01) |
| ***E04H 15/34*** | (2006.01) |
| ***E04H 4/10*** | (2006.01) |
| ***E04H 15/58*** | (2006.01) |

(52) U.S. Cl.
CPC ..... *E04H 15/02* (2013.01); *E04H 4/108* (2013.01); *E04H 15/34* (2013.01); *E04H 15/58* (2013.01)

(58) Field of Classification Search
CPC ..... E04H 1/1222; E04H 15/02; E04H 15/18; E04H 15/34; E04H 15/58; E04H 4/108; A47B 83/04
USPC ..... 135/20.1, 117, 143, 155, 157, 161; 52/36.2, 36.4; 108/47, 50.12; 4/494, 4/496, 498, 503
See application file for complete search history.

(56) References Cited

U.S. PATENT DOCUMENTS

| | | | | | |
|---|---|---|---|---|---|
| 1,407,040 | A | * | 2/1922 | Myers | E04H 15/003 135/118 |
| 1,846,011 | A | * | 2/1932 | Adams | E04H 15/48 135/117 |
| 1,961,915 | A | * | 6/1934 | Salmen, Jr. | E04H 15/324 135/143 |
| 2,130,919 | A | * | 9/1938 | Erickson | E04H 15/46 135/118 |
| 2,151,908 | A | * | 3/1939 | Gottlieb | E04B 1/3441 135/117 |
| 2,182,283 | A | * | 12/1939 | Curtis | E04H 15/48 135/117 |
| 2,492,198 | A | * | 12/1949 | Smith | A47F 5/108 135/117 |
| 2,836,860 | A | * | 6/1958 | Staropoli | E04B 1/34326 108/158.11 |
| 2,890,498 | A | * | 6/1959 | Bigelow | E04H 15/008 135/143 |
| 2,912,703 | A | * | 11/1959 | Murphy | E04H 4/084 135/148 |
| 2,970,600 | A | * | 2/1961 | Schultz | E04H 15/003 135/118 |
| 3,002,195 | A | | 10/1961 | Prudek | |
| 3,101,731 | A | | 8/1963 | Stiglin | |
| 3,744,195 | A | * | 7/1973 | Ferkich | E04H 1/1272 135/117 |
| 3,854,149 | A | | 12/1974 | Mischke | |
| D274,157 | S | * | 6/1984 | Freeland | D25/56 |
| 5,035,253 | A | * | 7/1991 | Bortles | E04H 15/50 135/117 |
| 5,135,192 | A | * | 8/1992 | Winkler | E04H 12/2223 248/156 |

(Continued)

FOREIGN PATENT DOCUMENTS

| | | | | |
|---|---|---|---|---|
| CA | 2088948 | A * | 8/1994 | |
| FR | 2753220 | A1 * | 3/1998 | E04H 1/1222 |
| FR | 3007444 | A1 * | 12/2014 | |

*Primary Examiner* — Robert Canfield
(74) *Attorney, Agent, or Firm* — Robert C. Montgomery; Montgomery Patent and Design, LP.

(57) ABSTRACT

A canopy and table frame assembly includes a frame formed by a plurality of interconnected frame members. A canopy is connected to an upper portion of the frame members. A portion of the frame members and the canopy are positioned over at least a portion of an above ground pool. The frame includes a pool side bar connected between frame members.

8 Claims, 6 Drawing Sheets

(56) References Cited

U.S. PATENT DOCUMENTS 5,352,015 A * 10/1994 Morgan ..... A47B 3/04 297/188.01
5,396,916 A * 3/1995 Boissonnault ..... A45B 7/005 135/16
5,636,649 A 6/1997 Horvath
6,276,382 B1 8/2001 Bindschatel et al.
6,283,136 B1 * 9/2001 Chen ..... E04H 15/48 135/130
6,474,244 B1 11/2002 Karpinski
6,571,403 B2 6/2003 Wheaton
6,718,995 B2 * 4/2004 Dotterweich ..... E04H 15/50 135/117
7,775,229 B2 * 8/2010 Sy-Facunda ..... E04H 15/48 135/117
8,371,321 B2 2/2013 Affolter
8,616,226 B2 * 12/2013 Ma ..... E04H 15/50 135/117
2002/0046508 A1 * 4/2002 Lekhtman ..... A47F 9/00 52/36.1
2002/0092555 A1 * 7/2002 Chen ..... E04H 15/50 135/144
2007/0051397 A1 * 3/2007 Choi ..... E04H 15/50 135/131
2008/0017230 A1 * 1/2008 Carter ..... E04H 15/58 135/117
2009/0277487 A1 * 11/2009 Holacka ..... E04H 15/003 135/154
2010/0326485 A1 * 12/2010 Li ..... E04H 15/16 135/122
2011/0204756 A1 * 8/2011 DeMars ..... A47F 9/00 312/140.2
2013/0240007 A1 * 9/2013 Ashton ..... E04H 15/58 135/161
2015/0252587 A1 * 9/2015 Lovley, II ..... E04H 15/00 135/121
2015/0296975 A1 * 10/2015 Choi ..... A47B 3/083 108/50.12

* cited by examiner

CANOPY AND TABLE FRAME ASSEMBLY

RELATED APPLICATIONS

The present invention was first described in and claims the benefit of U.S. Provisional Application No. 62/061,920 filed Oct. 9, 2014, the entire disclosures of which are incorporated herein by reference.

FIELD OF THE INVENTION

The present invention relates generally to a modular canopy and table frame assembly.

BACKGROUND OF THE INVENTION

Very few leisure time activities rival that of spending a warm summer day in a swimming pool. Whether it is a large, in-ground, Olympic size pool, or a small backyard above ground pool, the relaxation and comfort that is derived from swimming is a healthy benefit for all. However, one (1) thing that quickly takes away from this pleasure occurs when swimming under bright sunlight conditions.

Not only are the rays of the sun uncomfortably hot, they are also detrimental to the health of one's eyes and skin. Any cautious individual who ventures into a pool must repeatedly apply sun block lotion and even with such lotion a person will typically get out even after a brief period of time due to sun exposure. Accordingly, the need has developed for a means of generating shade near a pool that addresses the aforementioned problems. The use of the canopy and table frame assembly allows pool users the ability to swim in their backyard pool in shady conditions thereby enjoying increased usability of their pool in a manner which is quick, easy, and effective.

SUMMARY OF THE INVENTION

The inventor has recognized the aforementioned inherent problems and lack in the art and observed that there is a need for a canopy and table frame assembly.

It is therefore an object of the invention to provide a canopy assembly, comprising a frame, adapted to be anchored to a ground surface and a top face removably attached to the frame via a plurality of fasteners. The top face is configured to cover an area of ground. The frame further comprises a first plurality of vertical support members, a second plurality of vertical support members, a pair of horizontal support members laterally disposed between the first and second plurality of vertical support members, a first cross member attached to first ends of the pair of lateral horizontal support members and a second cross member attached to second ends of the pair of lateral horizontal support members. The top face is removably attached to the pair of horizontal support members, the first cross member, and the second cross member.

The canopy assembly further comprises a first lateral shade, a second lateral shade and an end shade. The first lateral shade and the second lateral shade is removably attached to one (1) of the pair of horizontal support members and the end shade is removably attached to the second cross member. There is at least one (1) mid-member attached to and spanning a distance between each of the pair of horizontal support members. The top face is removably attached to each mid-member. The frame further comprises a plurality of corner braces, each attached to one (1) of the first plurality of vertical support members. The frame also comprises a plurality of cantilever braces, each attached to one (1) of the second plurality of vertical support members. The first lateral shade and second lateral shade are each partially attached to a respective adjacent one of the pair of horizontal support members and the first cross member. The second plurality of vertical support members is fixed into the ground surface by removable attachment to an anchor stake. The anchor stake further comprises a corkscrew shape.

The canopy assembly also comprises a frame, adapted to be anchored to a ground surface; a top face removably attached to the frame via a plurality of fasteners and a table having a planar surface, adapted to be partially supported by a sidewall of a swimming pool and affixed to a lower portion of the frame. The top face is configured to cover an area of ground. This canopy assembly further comprises a first plurality of vertical support members; a second plurality of vertical support members; a pair of horizontal support members laterally disposed between the first and second plurality of vertical support members; a first cross member attached to first ends of the pair of horizontal support members; and, a second cross member attached to second ends of the pair of horizontal support members. The top face is removably attached to the pair of horizontal support members, the first cross member, and the second cross member.

This canopy assembly also comprises a first lateral shade, a second lateral shade and an end shade. The first lateral shade and the second lateral shade is removably attached to one (1) of the pair of the lateral horizontal support members and wherein the end shade is removably attached to the second cross member. There is at least one (1) mid-member attached to and spanning a distance between each of the pair of horizontal support members, wherein the top face is removably attached to each mid-member. The frame further comprises a plurality of corner braces, each attached to one (1) of the first plurality of vertical support members. The frame further comprises a plurality of cantilever braces, each attached to one (1) of the second plurality of vertical support members. Each of the second plurality of vertical support members is fixed into the ground surface by removable attachment to an anchor stake. The anchor stake further comprises a corkscrew shape.

The table further comprises a plurality of braces, each connected into one (1) of the first plurality of vertical support members. The table also comprises a plurality of drain apertures within the planar surface; a plurality of slots within the planar surface and a plurality of securement straps. Each of the straps is passed through each slot to adaptably secure the table to an upper framing member the sidewall of the swimming pool. The first lateral shade and second lateral shade are each partially attached to a respective adjacent one of the pair of horizontal support members and the first cross member.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
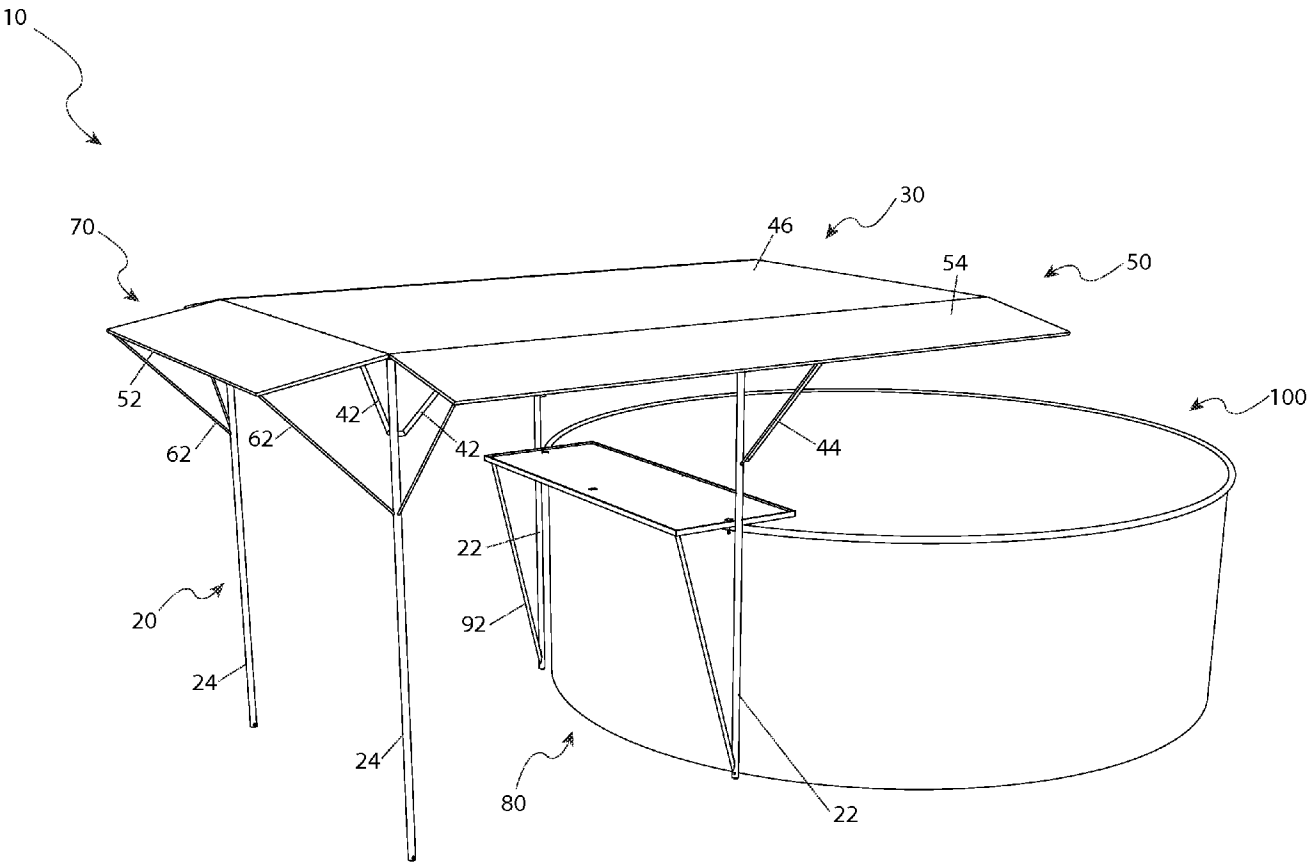
FIG. 1 is a perspective view of a canopy 10 with side table 80 in accordance with the preferred embodiment of the present invention.

10 canopy with side table
20 frame
22 first vertical support
24 second vertical support
26 anchor stake
28 anchor stake fastener
30 top face
32 lateral horizontal member
34*a* first cross member
34*b* second cross member
36 mid member
42 corner brace
44 cantilever brace
46 top face cover
48 top face cover tie
50 first lateral shade
52 shade frame
54 shade cover
56 shade cover tie
60 second lateral shade
62 shade support arm
64 shade pivot
70 end shade
72 end shade cover
80 table
82 table lip
84 table aperture
86 slot
88 securement strap
92 table brace
94 table brace aperture
96 support brace fastener
100 swimming pool

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a canopy with a side table (herein referred to as the "apparatus") 10, which provides a sun cover for at least a portion of an above ground swimming pool 100 and a table 80 having a planar surface at a location around the perimeter and above a sidewall of that swimming pool 100. The preferred embodiment of the apparatus 10 is configured to be built around a four foot (4 ft.) high swimming pool 100, however, other embodiments can be accomplished by the incorporation of an elevated platform having the pool side table 80 located approximately forty eight inches (48 in.) above that platform.

Figure 2:
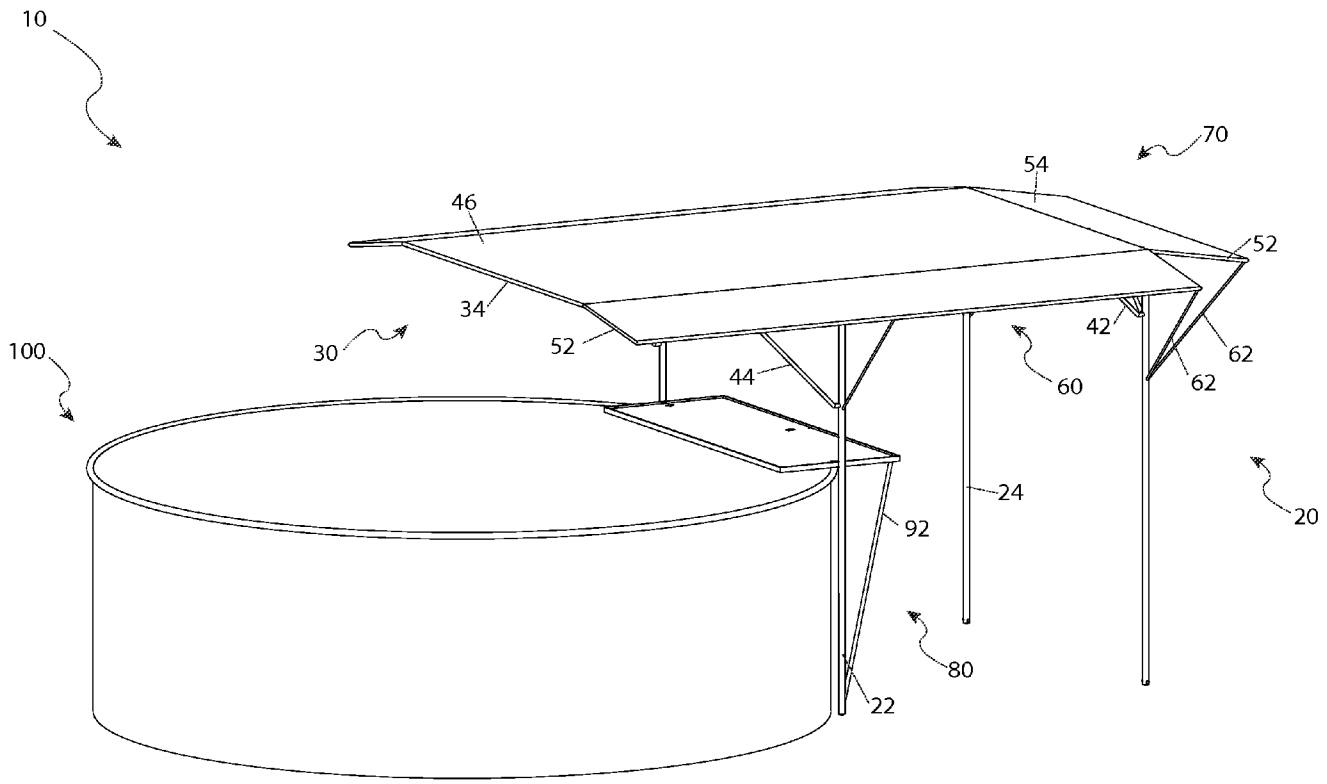
FIG. 2 is another perspective view of a canopy 10 with side table 80 in accordance with the preferred embodiment of the present invention.
Figure 6:
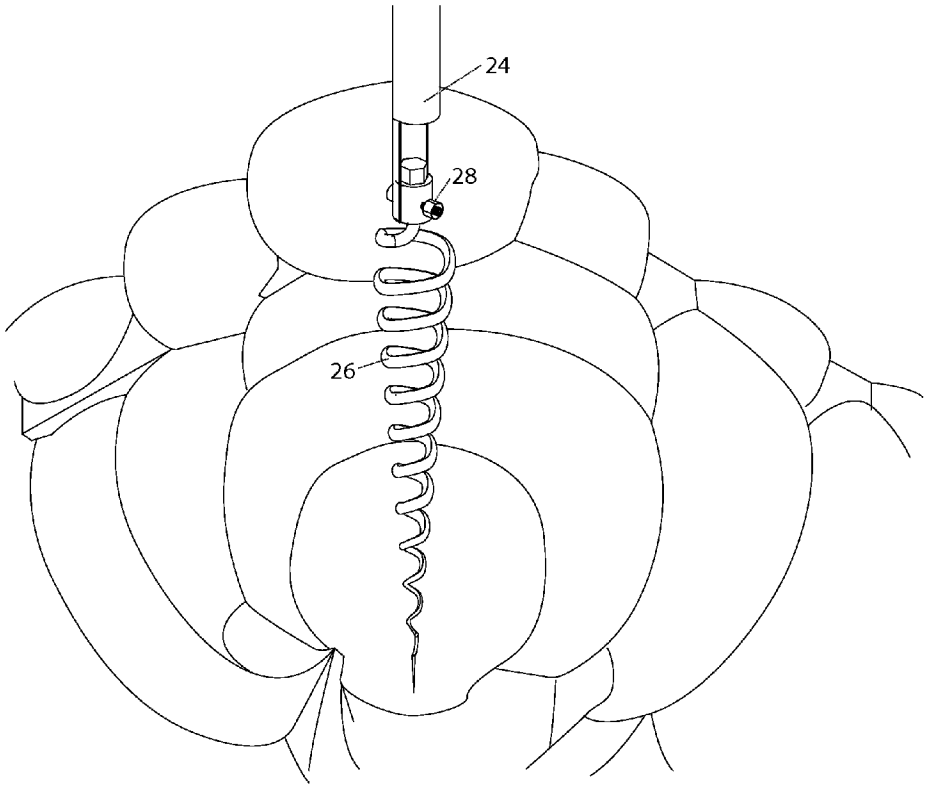

Referring now to FIGS. 1 and 2, isometric views, and FIG. 3, an isolated view of the frame 20, of the apparatus 10, according to the preferred embodiment of the present invention, are disclosed. The apparatus 10 includes a plurality of vertical supports 22, 24 with preferably a fabric top face cover 46, and a table 80 partially supported on the frame of the swimming pool 100 and partially supported by table braces 92 connected into the first vertical supports 22. At least two (2) first vertical supports 22 are positioned in proximity of the vertical structural supports of the frame of the swimming pool 100. A pair of second vertical supports 24 is fixed into the ground by anchor stakes 26. The anchor stakes 26 are preferably corkscrew type fixtures which are threaded into the soil. The second vertical supports 24 are affixed to the anchor stakes 26 by means of an anchor stake fastener 28 inserted into aligned apertures in a lower end of the second vertical support 24 and an upper end of the anchor stake 26 projecting from the ground as seen in FIG. 6. The preferred material for the vertical supports 22, 24 and the horizontal members 32 is steel, utilizing either pipe or tubing of a sufficient cross-sectional size and shape to adequately accommodate the loading placed thereon by all considered influences. It is understood, however, that other materials, such as other metals, or PVC, may be utilized without limiting the scope of the apparatus 10. It is understood that the anchor stakes 26 may also be used to secure the first vertical supports 22 to the ground.

A pair of parallel lateral horizontal members 32 is attached perpendicularly at either end of a first cross member 34*a* and a second cross member 34*b*. The abutting joints of the lateral horizontal members 32 and the cross members 34*a*, 34*b* are mitered at appropriate intersecting angles to provide a smooth fit and a full penetration weld. At least one (1) mid-member 36 is positioned between the lateral horizontal members 32 and continuously welded, with appropriate bead, around the perimeter of each end to permanently secure the mid-member 36. The mid-member 36 spans the distance between the lateral horizontal members 32. The frame 20 is provided with a protective coating, or plating, to inhibit corrosion. The lateral horizontal members 32, with the attached cross members 34*a*, 34*b* and the mid-member 36, are subsequently attached to an upper end of the vertical supports 22, 24 in such a way as to form a unitary frame 20 having a generally planar top face 30. The top face 30 is configured to constitute a larger area than an area bounded by the vertical supports 22, 24 and therefore the top face 30 is displaced toward the swimming pool 100 so as to have a portion cantilevered over the swimming pool 100. A cantilever brace 44 is installed, preferably by welding, between each of the first vertical supports 22 and the respective lateral horizontal member 32. The cantilever brace 44 is installed on the side of the first vertical support 22 toward the cantilevered portion of the top face 30 so as to reinforce the structural integrity of the frame 20. The cantilever brace is configured to be oriented at approximately a forty five degree (45°) angle with the normal. A corner brace 42 is installed, preferably by welding, between each second vertical support 24 and the respective lateral horizontal member 32 as well as between each second vertical support 24 and the respective end of the first cross member 34*a* attached between the second vertical supports 24. These corner braces 42, oriented in two (2) perpendicular planes, are positioned at a forty five degree (45°) angle with the normal. The corner braces 42 reinforce the structural integrity of the frame 20.

A top face cover 46 is attached to an upper side of the structural members 32, 34*a*, 34*b* and 36 of the top face 30 with a plurality of evenly spaced top face cover ties 48. The top face cover 46 is preferably composed of a cotton canvas material and as such may be presented in a wide variety of colors and/or designs to suit the taste of a user. The top face cover 46 may be impregnated with such preservatives as may be necessary to impede the deterioration of the fabric due to normal weathering. The top face cover 46 may also be treated to block the transmission of the ultraviolet radiation band of sunlight. The top face cover ties 48 are preferably configured be lengths of a textile material secured to a lower side of the top face cover 46, preferably by stitching, in such a manner as to allow two (2) dangling ends of each top face cover tie 48 to be tied around the members 32, 34*a*, 34*b* and 36 of the top face 30. In an alternate embodiment the top face cover ties 46 may be configured to be portions of the top face cover 46 provided with the complimentary parts of a hook-and-loop fastener, such as VELCRO®, which can be wrapped around the structural members 32, 34*a*, 34*b* and 36 and secured to itself so as to attach the top face cover 46 to the top face 30.

Figures 3A, 3B:
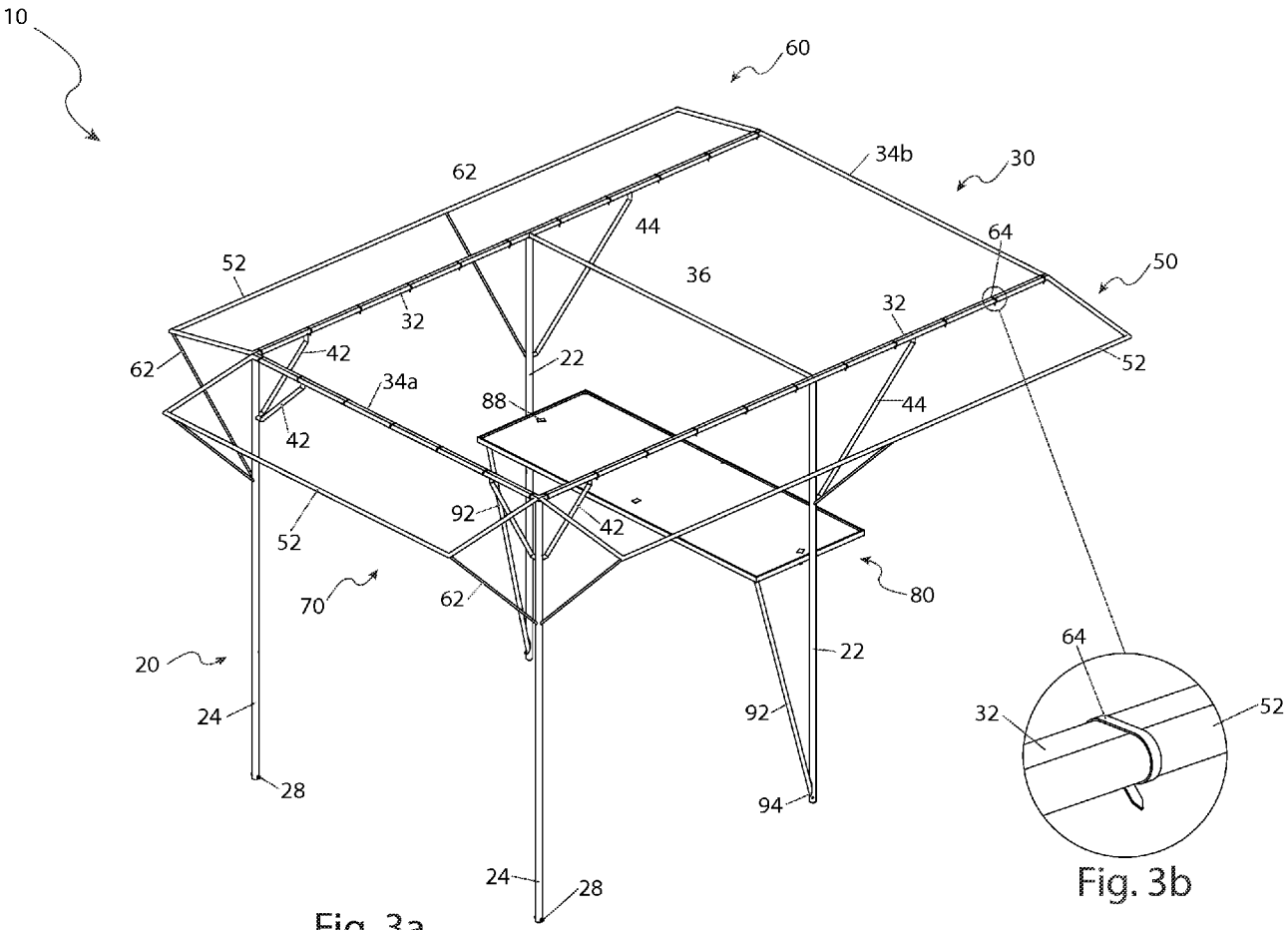
FIG. 3*a* is an isolated view of a frame 20 of the canopy 10 in accordance with a preferred embodiment of the present invention.
FIG. 3*b* is an isolated close-up view of a shade pivot 64 of the canopy 10 in accordance with a preferred embodiment of the present invention.
Figure 5:
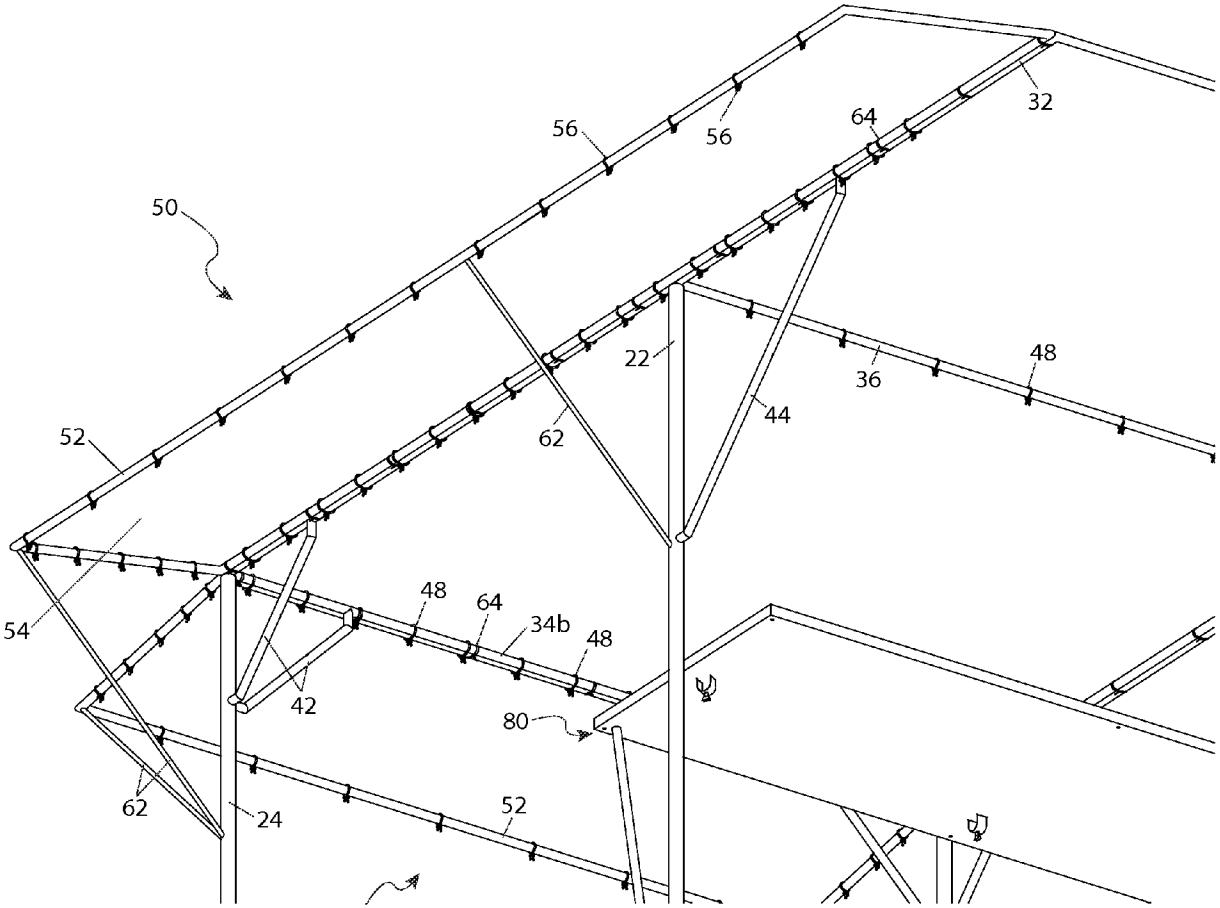
FIG. 5 is an isolated view of a first lateral shade 50 of the canopy 10 in accordance with the preferred embodiment of the present invention; and, FIG. 6 is a cut-away view of a subterranean anchor stake 26 at a lower end of a second vertical support 24 of the canopy 10 in accordance with the preferred embodiment of the present invention.

A first lateral shade 50 and a second lateral shade 60 are attached to each of the lateral horizontal members 32. The first lateral shade 50 and the second lateral shade 60 are configured to be similar rectangular, welded, tubular shade frames 52 each having a shade cover 54 as more clearly illustrated in FIG. 5. An end shade 70 is attached to the first cross member 34*a* opposite from the swimming pool 100. The end shade 70 is constructed in a similar manner to the lateral shades 50, 60 with a rectangular, welded, tubular shade frame 52 having a proportionately adjusted shade cover 54. Each shade cover 54 is attached to an upper side of the respective shade frame 50, 60, 70 with a plurality of cover ties 56. The cover ties 56 are configured in the same manner as the top face cover ties 48. The shade covers 54 are preferably composed of the same constituent material as the top face cover 46 and may be presented in any color, complimentary or supplementary, and/or pattern, continuation or contrasting, as may suit the taste of a user. The shades 50, 60, and 70 are pivotally attached to the lateral horizontal members 32 and the first cross member 34*a* of the top face 30, preferably by means of a plurality of shade pivots 64 as seen in FIG. 3*b*. In a preferred embodiment, the shade pivots 64 are configured to be evenly spaced, pliable, plastic zip ties. A zip tie is a commercially available device utilized in a wide variety of fastening schema having a uni-directional clasp on a first end into which a second end is inserted to form a loop, having selectable detent cavities available to the clasp, and collapsed about one (1) or more objects. The shades 50, 60, and 70 are rotated about the respective shade pivots 64 to a predetermined orientation and maintained in that position with the insertion of a plurality of fixed length shade support arms 62 into apertures (not shown) in the various vertical supports 22, 24 and in the shade frames 52 as depicted in FIG. 5. The shade support arms 62 are configured to be wood, or metal, cylindrical rods. Multiple disposition angles of the shades 50, 60, 70 can be achieved by having, or providing, a selection of shade support arms 62 in different lengths. In an alternate embodiment, the shade support arms 62 may be configured to be extendable rods having some internal, or external, adjustment means in order to provide multiple disposition angles.

Figure 4B:
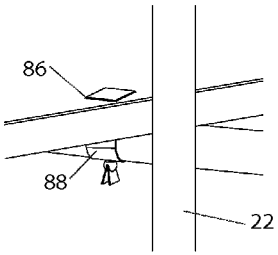
FIG. 4*b* is an isolated view of a securement strap 88 of the table 80 of the canopy 10 in accordance with the preferred embodiment of the present invention.
Figure 4C:
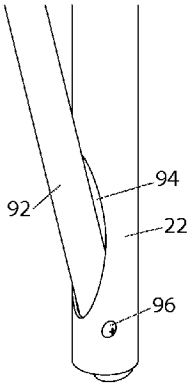
FIG. 4*c* is an isolated view of a table brace aperture 94 in a first vertical support 22 of the canopy 10 in accordance with the preferred embodiment of the present invention.
Figure 4A:
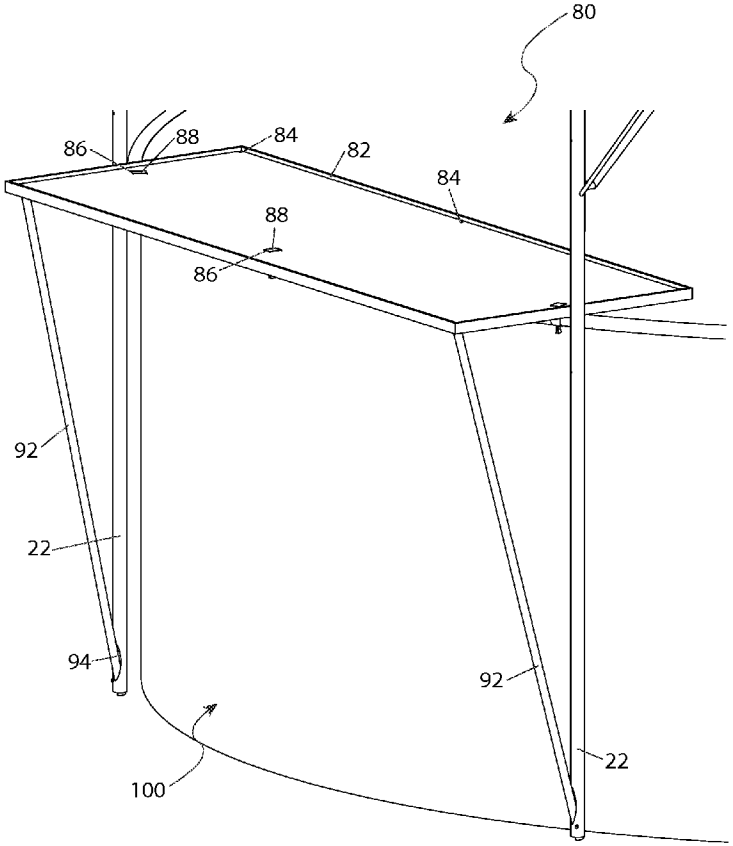
FIG. 4*a* is an isolated view of a table 80 of the canopy 10 in accordance with the preferred embodiment of the present invention.

Referring now to FIG. 4*a*, an isolated view of the table 80 of the apparatus 10, according to the preferred embodiment of the present invention, is disclosed. The table 80 is supported, in part, by some upper sidewall structure of the swimming pool 100 in a preferred embodiment. Additional support for the planar table 80 is provided by at least two (2) table braces 92. The table brace 92 is preferably a round tube, or pipe, attached to an underside of the table 80 at an upper end and supported in a table brace aperture 94 in the first vertical support 22 by a support brace fastener 96 at a lower end thereof as shown in FIG. 4*c*. The table 80 is preferably a rectangular, planar platform having an upwardly projecting peripheral table lip 82 as a means of retaining items placed thereon. Disposed around the periphery of the table 80, just inside the table lip 82, is a plurality of table apertures 84, configured to be holes through the table 80 for drainage of any liquids spilled thereupon. The table 80 is provided with paired slots 86 for the installation of securement straps 88. The location of the paired slots 86 coincides preferably with an upper framing member of the swimming pool 100. The securement straps 88 are straps of a fabric material, such as woven nylon, the ends of which are inserted through the slots 86, wrapped under the framing member of the swimming pool 100, and fastened by tying as portrayed in FIG. 4*b*.

An alternate embodiment of the apparatus 10 may be configured to be constructed with either steel or PVC pipe and applicable plumbing fittings, such as elbows, tees, reducers, and the like, in order to produce a product which is more adaptable to a particular user's circumstances.

The preferred embodiment of the present invention can be utilized by an enabled individual in a simple and straightforward manner with little or no training. After initial purchase or acquisition of the apparatus 10, it would be installed as indicated in FIG. 1 and FIG. 2. The method of installing and utilizing the apparatus 10 may be achieved by performing a series of steps. It can be appreciated that the operational steps may be performed in alternative order and as such any operational description of use should not be viewed as a limiting factor. Utilizing the apparatus 10 may be achieved by performing the following steps: acquiring a model of the apparatus 10 having a desired size and style to suit the taste of a user; having the apparatus 10 installed by a qualified provider of such services; adjusting the lateral shades 50, 60 as necessary; adjusting the end shade 70 as necessary; and enjoying the shade while utilizing the swimming pool 100. The canopy 10 can be further appointed or decorated with the addition of auxiliary lighting to enhance nighttime usage.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A canopy assembly, comprising:

a frame, adapted to be anchored to a ground surface, comprising:

a first plurality of vertical support members;

a second plurality of vertical support members;

a pair of horizontal support members laterally disposed between said first and second plurality of vertical support members;

a first cross member attached to first ends of said pair of horizontal support members; and, a second cross member attached to second ends of said pair of horizontal support members;

a top face removably attached to said pair of horizontal support members, said first cross member, and said second cross member via a plurality of fasteners; and, a table having a planar surface, adapted to be partially supported by a sidewall of a swimming pool, and affixed to a lower portion of said frame, comprising:

a plurality of braces, each connected into one of said first plurality of vertical support members;

a plurality of drain apertures within said planar surface;

a plurality of slots within said planar surface; and, a plurality of securement straps;

wherein each of said straps is passed through each slot to adaptably secure said table to an upper framing member of said sidewall of said swimming pool;

wherein said top face is configured to cover an area of ground.

2. The canopy assembly of claim 1, further comprising:

a first lateral shade;

a second lateral shade; and, an end shade;

wherein each said first lateral shade and said second lateral shade is removably attached to one of said pair of said lateral horizontal support members; and, wherein said end shade is removably attached to said second cross member.

3. The canopy system of claim 1, further comprising at least one midmember attached to and spanning a distance between each of said pair of horizontal support members; wherein said top face is removably attached to each midmember.

4. The canopy assembly of claim 1, wherein said frame further comprises a plurality of corner braces, each attached to one of said first plurality of vertical support members.

5. The canopy assembly of claim 1, wherein said frame further comprises a plurality of cantilever braces, each attached to one of said second plurality of vertical support members.

6. The canopy assembly of claim 1, wherein each said second plurality of vertical support members is fixed into said ground surface by removable attachment to an anchor stake.

7. The canopy assembly of claim 6, wherein said anchor stake further comprises a corkscrew shape.

8. The canopy assembly of claim 2, wherein said first lateral shade and second lateral shade are each pivotally attached to a respective adjacent one of said pair of horizontal support members and said first cross member.

* * * * *